US011821159B2

(12) United States Patent
Fujimoto et al.

(10) Patent No.: US 11,821,159 B2
(45) Date of Patent: Nov. 21, 2023

(54) REINFORCEMENT MEMBER AND CONSTRUCTION METHOD

(71) Applicant: NIPPON TELEGRAPH AND TELEPHONE CORPORATION, Tokyo (JP)

(72) Inventors: Norihiro Fujimoto, Tokyo (JP); Tomoyasu Nagai, Tokyo (JP); Shunsuke Tsuda, Tokyo (JP); Takashi Sugiura, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 344 days.

(21) Appl. No.: 17/046,634

(22) PCT Filed: Mar. 26, 2019

(86) PCT No.: PCT/JP2019/012763
§ 371 (c)(1),
(2) Date: Oct. 9, 2020

(87) PCT Pub. No.: WO2019/198492
PCT Pub. Date: Oct. 17, 2019

(65) Prior Publication Data

US 2021/0108391 A1 Apr. 15, 2021

(30) Foreign Application Priority Data

Apr. 13, 2018 (JP) ..... 2018-077617

(51) Int. Cl.
*E04B 1/38* (2006.01)
*E02D 29/14* (2006.01)

(52) U.S. Cl.
CPC ..... *E02D 29/1481* (2013.01); *E02D 2600/20* (2013.01); *E04B 2001/405* (2013.01)

(58) Field of Classification Search
CPC ..... E02D 29/12; E04B 2001/405; E04B 1/58
See application file for complete search history.

(56) References Cited

FOREIGN PATENT DOCUMENTS

| | | | |
|---|---|---|---|
| FR | 2494331 | A1 * | 5/1982 |
| JP | S60168819 | A | 9/1985 |
| JP | S62108418 | U | 7/1987 |
| JP | H10331437 | A | 12/1998 |
| JP | 2002129589 | A | 5/2002 |
| JP | 200335036 | A | 2/2003 |

(Continued)

*Primary Examiner* — Sunil Singh

(57) ABSTRACT

Provided are a reinforcing member and a construction method capable of easily securing a side wall contact height even in the case where installed equipment is provided on a side wall. A reinforcing member according to the present invention is a reinforcing member which reinforces a manhole by being fixed to the manhole in a state in which at least part of the reinforcing member is in contact with a side wall inner surface of an inner surface of the manhole, an insertion hole into which an anchor bolt provided to protrude from the inner surface of the manhole can be inserted is formed, and the insertion hole is an elongated hole which allows the reinforcing member to move relative to the anchor bolt in an inserted state in which the anchor bolt is inserted into the insertion hole and an unfixed state in which the reinforcing member is not fixed to the manhole.

20 Claims, 12 Drawing Sheets

(56) References Cited

FOREIGN PATENT DOCUMENTS

| | | | |
|---|---|---|---|
| JP | 200645917 | A | 2/2006 |
| JP | 2007303071 | A | 11/2007 |
| JP | 20082175 | A | 1/2008 |
| JP | 2012219555 | A | 11/2012 |
| JP | 5377563 | B2 | 10/2013 |

* cited by examiner (SIDE WALL CONTACT HEIGHT 90mm)

(SIDE WALL CONTACT HEIGHT 110mm)

CRACK C IS NOT FORMED

REINFORCEMENT MEMBER AND CONSTRUCTION METHOD

CROSS-REFERENCE TO RELATED APPLICATIONS

This application is a U.S. 371 Application of International Patent Application No. PCT/JP2019/012763, filed on 26 Mar. 2019, which application claims priority to and the benefit of JP Application No. 2018-077617, filed on 13 Apr. 2018, the disclosures of which are hereby incorporated herein by reference in their entireties.

TECHNICAL FIELD

The present invention relates to a reinforcing member and a construction method which reinforce a manhole.

BACKGROUND ART

Facilities exposed to external environment deteriorate over time. A manhole which is a concrete structure buried underground is no exception. Accordingly, a technique for reinforcing the manhole is required.

PTL 1 discloses a technique for fixing an upper portion of a side wall to an upper floor slab and fixing a lower portion of the side wall to a lower floor slab with reinforcing members in a central portion on a longitudinal side of the side wall of a rectangular manhole.

CITATION LIST

Patent Literature

[PTL 1] Japanese Patent No. 5377563

SUMMARY OF THE INVENTION

Technical Problem

It is possible to reinforce the manhole by using the technique disclosed in PTL 1. As a result of elaborate studies conducted repeatedly, the inventors of the present application have obtained knowledge that it is possible to further enhance the effect of reinforcing the manhole by increasing the vertical length of the reinforcing member in contact with the side wall (hereinafter described as a "side wall contact height" in some cases) in the technique disclosed in PTL 1.

However, there are cases where installed equipment such as a flat steel bar member used for housing, e.g., a cable or the like is attached to a side wall inner surface of the manhole. In the case where the reinforcing member is constructed by using an anchor bolt provided to protrude from an inner surface of the manhole as a guide member, when the side wall contact height of the reinforcing member is increased, there are cases where the reinforcing member interferes with the above-described installed equipment. That is, when the side wall contact height of the reinforcing member is increased, there are cases where it becomes difficult to construct the reinforcing member due to a relationship with the installed equipment.

An object of the present invention is to provide a reinforcing member and a construction method capable of easily securing a side wall contact height even in the case where installed equipment is provided on a side wall.

Means for Solving the Problem

A reinforcing member as a first aspect of the present invention is a reinforcing member which reinforces a manhole by being fixed to the manhole in a state in which at least part of the reinforcing member is in contact with a side wall inner surface of an inner surface of the manhole, wherein an insertion hole into which an anchor bolt provided to protrude from the inner surface of the manhole can be inserted is formed, and the insertion hole is an elongated hole which allows the reinforcing member to move relative to the anchor bolt in an inserted state in which the anchor bolt is inserted into the insertion hole and an unfixed state in which the reinforcing member is not fixed to the manhole.

The reinforcing member as an embodiment of the present invention preferably includes a side wall contact portion which is in contact with the side wall inner surface of the manhole in a fixed state in which the reinforcing member is fixed to the manhole, and the side wall contact portion can preferably move in a direction orthogonal to a longitudinal direction of the manhole in the inserted state and the unfixed state.

The reinforcing member as the embodiment of the present invention preferably includes a lower floor contact portion which is in contact with the lower floor inner surface of the manhole in the inserted state and the unfixed state, and the lower floor contact portion preferably constitutes a vertical position determination portion which determines a position in a vertical direction of the side wall contact portion in the fixed state by coming into contact with the lower floor inner surface in the inserted state and the unfixed state.

The reinforcing member as the embodiment of the present invention preferably includes a corner contact portion which is positioned between the side wall inner surface and the lower floor inner surface of the manhole and comes into contact with a corner inner surface inclined relative to the side wall inner surface and the lower floor inner surface, and the lower floor contact portion is preferably in contact with the lower floor inner surface and the corner contact portion is preferably in contact with the corner inner surface in the fixed state.

A construction method as a second aspect of the present invention is a construction method for fixing a reinforcing member to a manhole in a state in which at least part of the reinforcing member is in contact with a side wall inner surface of an inner surface of the manhole, the construction method including: inserting an anchor bolt provided to protrude from the inner surface of the manhole into an elongated hole formed in the reinforcing member; and adjusting a position of the reinforcing member in a fixed state in which the reinforcing member is fixed to the manhole by moving the reinforcing member relative to the anchor bolt in an inserted state in which the anchor bolt is inserted into the elongated hole and an unfixed state in which the reinforcing member is not fixed to the manhole.

As an embodiment of the present invention, the reinforcing member preferably includes a side wall contact portion which is in contact with the side wall inner surface of the manhole in the fixed state, and a position of the side wall contact portion in the fixed state is preferably adjusted by moving the reinforcing member in a direction orthogonal to a longitudinal direction of the manhole relative to the anchor bolt in the inserted state and the unfixed state.

As the embodiment of the present invention, the reinforcing member preferably includes a lower floor contact portion which is in contact with the lower floor inner surface of the manhole in the inserted state and the unfixed state, and a position in a vertical direction of the side wall contact portion in the fixed state is preferably determined by bringing the lower floor contact portion into contact with the lower floor inner surface in the inserted state and the unfixed state.

As the embodiment of the present invention, the reinforcing member preferably includes a corner contact portion which is positioned between the side wall inner surface and the lower floor inner surface of the manhole and comes into contact with a corner inner surface inclined relative to the side wall inner surface and the lower floor inner surface, and a position of the reinforcing member in the fixed state is preferably determined by bringing the side wall contact portion into contact with the side wall inner surface, bringing the lower floor contact portion into contact with the lower floor inner surface, and bringing the corner contact portion into contact with the corner inner surface.

Effects of the Invention

According to the present invention, it is possible to provide the reinforcing member and the construction method capable of easily securing the side wall contact height even in the case where the installed equipment is provided on the side wall.

DESCRIPTION OF EMBODIMENTS

Figure 1:
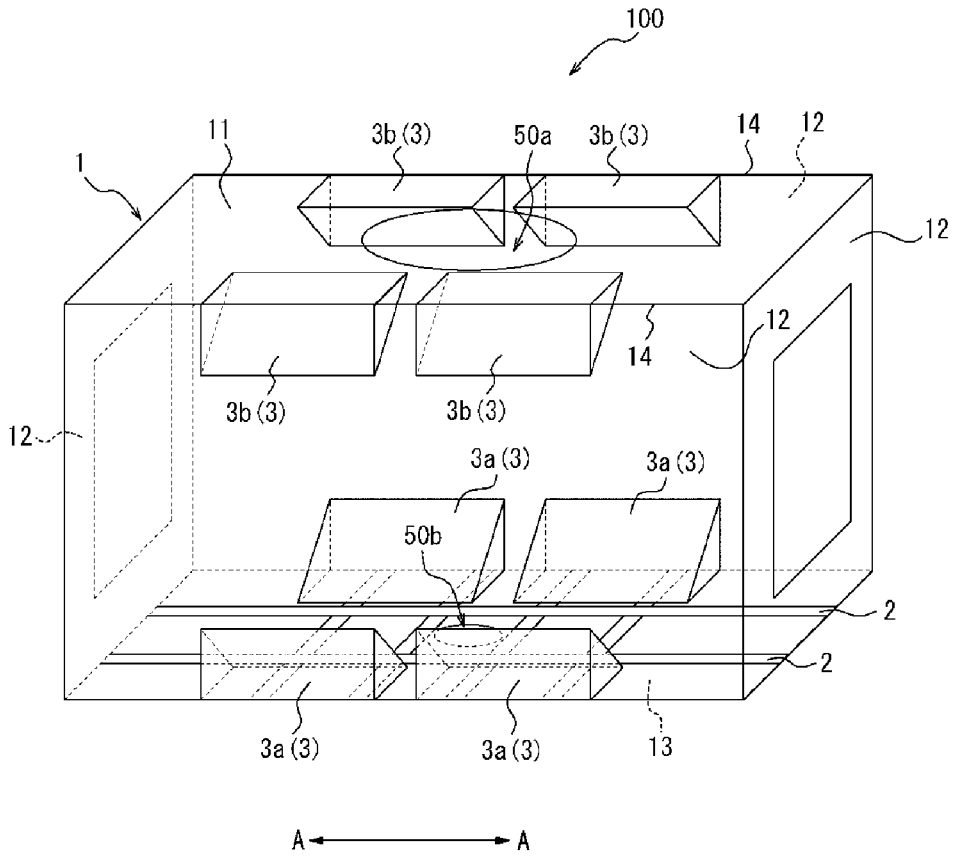
FIG. 1 is a schematic view showing an outline of a reinforcement structure of a manhole including a reinforcing member as an embodiment of the present invention.

Hereinbelow, a reinforcing member and a construction method according to the present invention will be described with reference to FIGS. 1 to 12. Common members and portions in the drawings are designated by the same reference numerals.

FIG. 1 is a schematic view showing an outline of a reinforcement structure 100 of a manhole 1 including a reinforcing member 3 as an embodiment of the present invention. The manhole 1 shown in FIG. 1 is a rectangular manhole, has an upper floor slab 11, a side wall 12, and a lower floor slab 13, and is buried underground. The reinforcement structure 100 reinforces the manhole 1.

Figure 2:
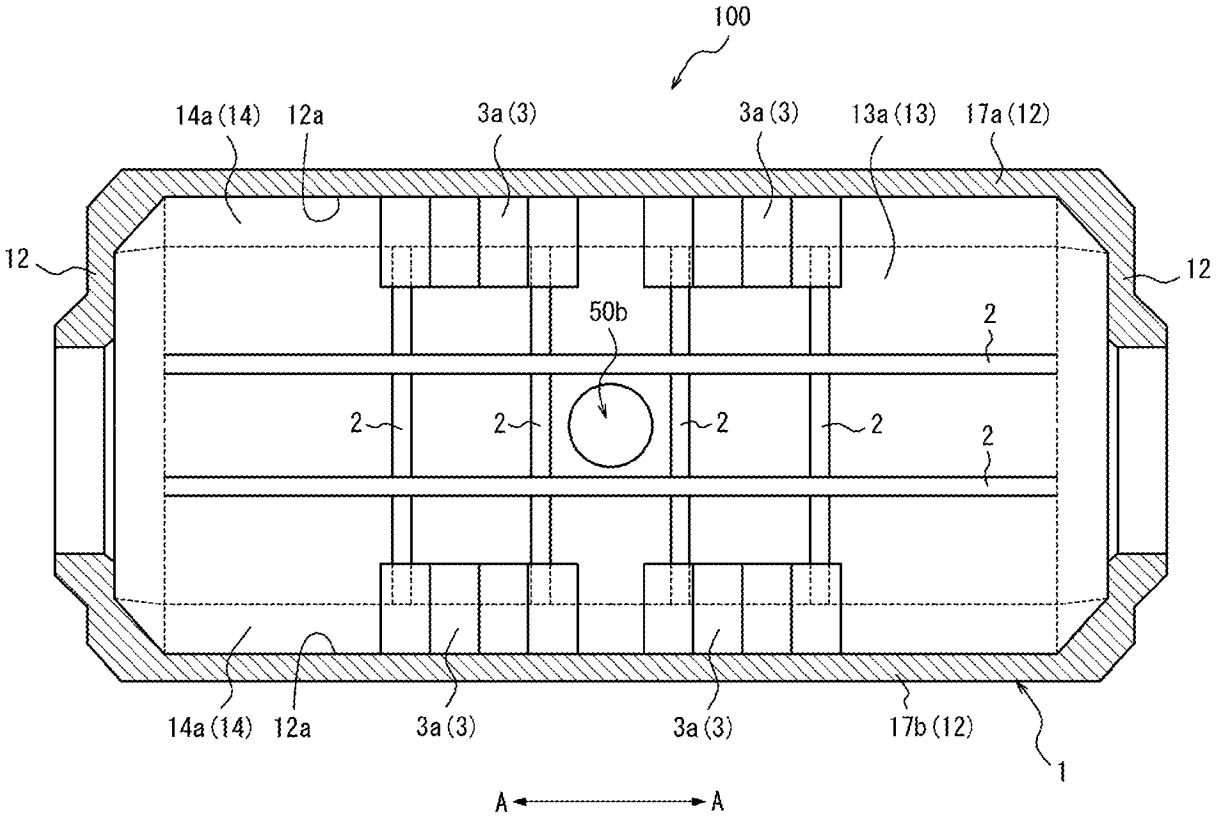
FIG. 2 is a cross-sectional view showing a cross section along a horizontal direction of the reinforcement structure shown in FIG. 1, and is a view when a lower floor slab is viewed from the side of an upper floor slab.
Figure 3:
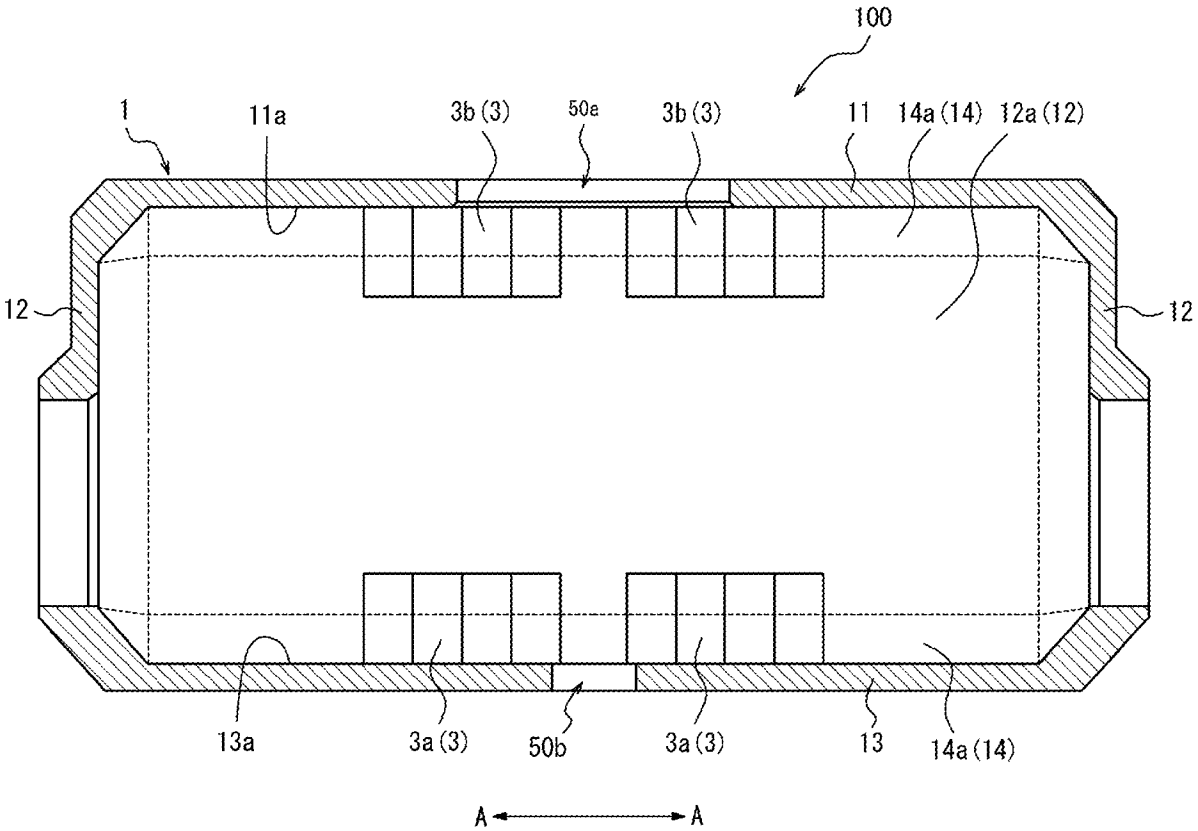
FIG. 3 is a cross-sectional view showing a cross section along a vertical direction of the reinforcement structure shown in FIG. 1, and shows a cross section along a longitudinal direction of the manhole.
Figure 4:
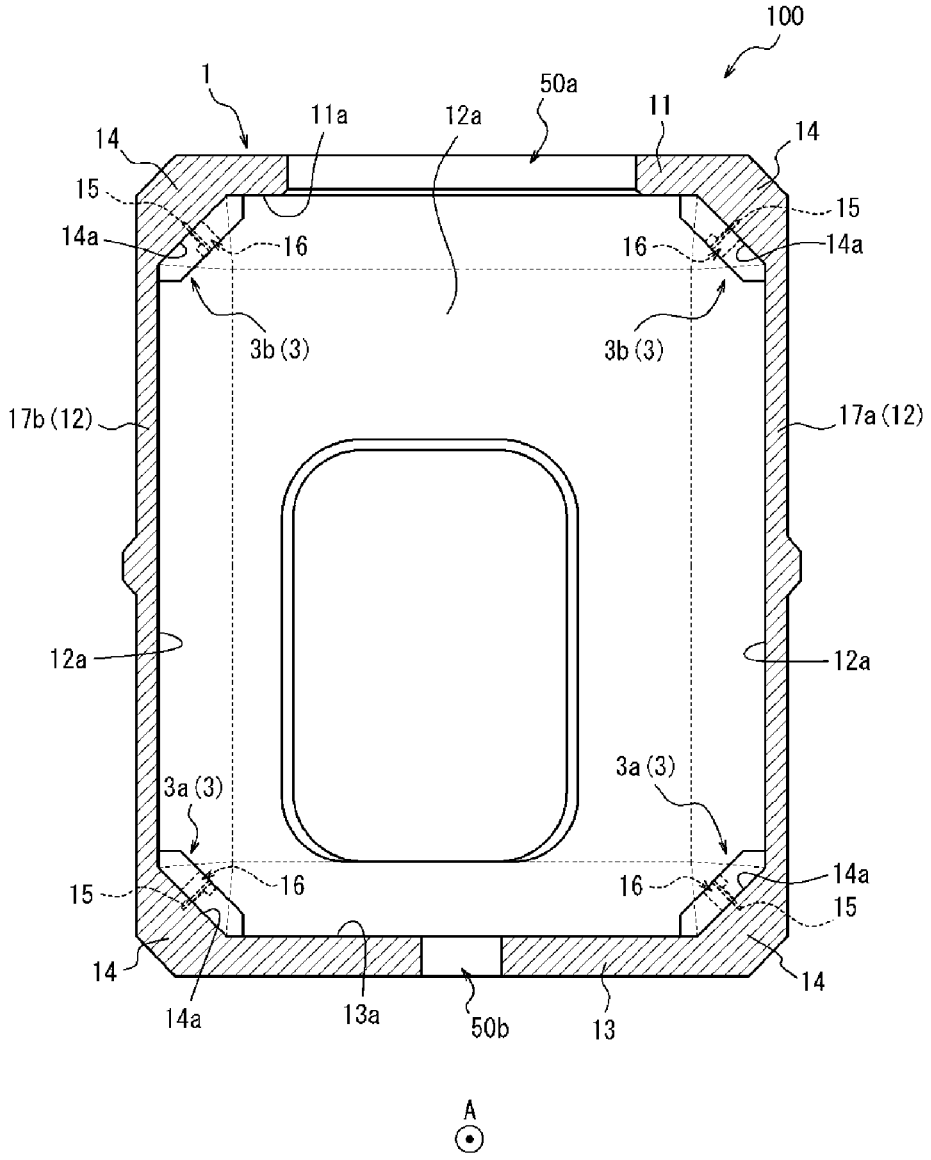
FIG. 4 is a cross-sectional view showing a cross section along the vertical direction of the reinforcement structure shown in FIG. 1, and shows a cross section orthogonal to the longitudinal direction of the manhole.

FIG. 2 is a cross-sectional view showing a cross section along a horizontal direction of the reinforcement structure 100 of the manhole 1 shown in FIG. 1, and is a view when the lower floor slab 13 is viewed from the side of the upper floor slab 11. FIG. 3 is a cross-sectional view showing a cross section along a vertical direction of the reinforcement structure 100 of the manhole 1 shown in FIG. 1, and shows a cross section along a longitudinal direction A of the manhole 1. FIG. 4 is a cross-sectional view showing a cross section along the vertical direction of the reinforcement structure 100 of the manhole 1 shown in FIG. 1, and shows a cross section orthogonal to the longitudinal direction A of the manhole 1. Note that, as shown in FIG. 1, an opening portion 50*a* is provided in the upper floor slab 11 of the manhole 1, but a configuration in which the opening portion 50*a* is not provided may also be adopted. Further, as shown in FIG. 2, a pit portion 50*b* for drainage or the like is provided in the lower floor slab 13 of the manhole 1, but a configuration in which the pit portion 50*b* is not provided may also be adopted.

As shown in FIGS. 1 to 4, an inner surface 11*a* (hereinafter described as an "upper floor inner surface 11*a*") of the upper floor slab 11 of the manhole 1 extends substantially parallel to the horizontal direction. An inner surface 13*a* (hereinafter described as a "lower floor inner surface 13*a*") of the lower floor slab 13 of the manhole 1 extends substantially parallel to the horizontal direction at a position which faces the upper floor inner surface 11*a*. An inner surface 12*a* (hereinafter described as a "side wall inner surface 12*a*") of the side wall 12 of the manhole 1 extends substantially parallel to the vertical direction.

Corner portions 14 are provided between the upper floor slab 11 and the side wall 12 of the manhole 1, and between the lower floor slab 13 and the side wall 12 of the manhole 1. In other words, inner surfaces 14*a* (hereinafter described as "corner inner surfaces 14*a*") of the corner portions 14 are positioned between the upper floor inner surface 11*a* and the side wall inner surface 12*a* of the manhole 1 and between the lower floor inner surface 13*a* and the side wall inner surface 12*a* of the manhole 1. The corner inner surfaces 14*a* are constituted by planes which are inclined (inclined by about 45 degrees in the present embodiment) relative to the upper floor inner surface 11*a*, the side wall inner surface 12*a*, and the lower floor inner surface 13*a*.

Figure 5:
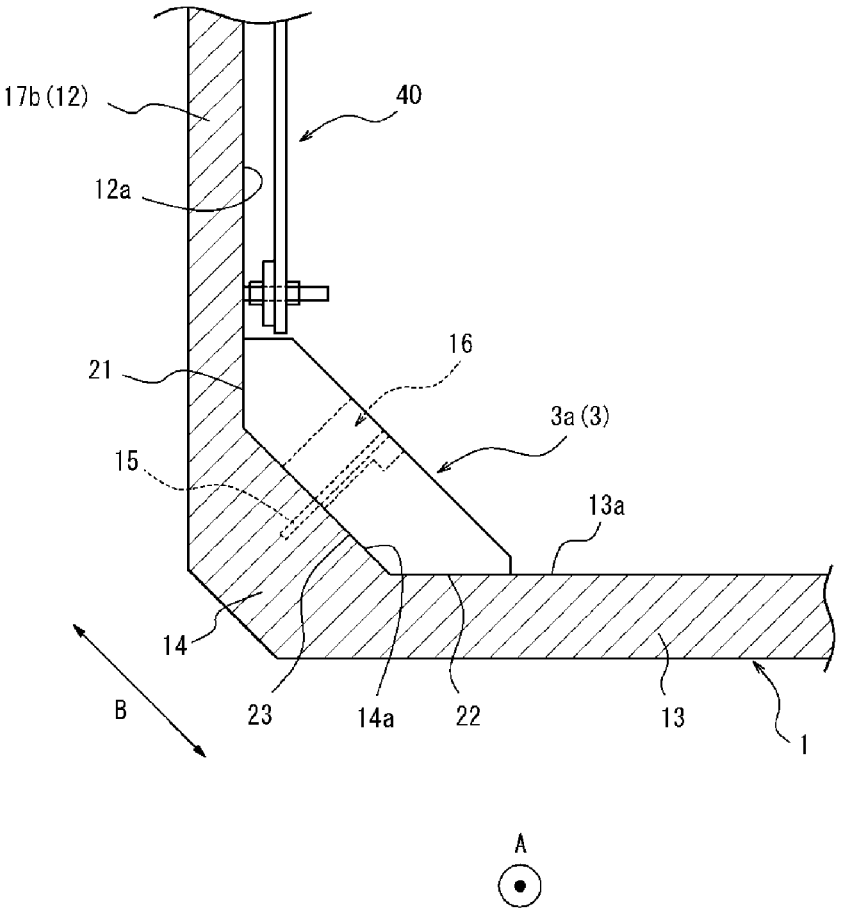
FIG. 5 is an enlarged cross-sectional view in which the vicinity of one corner portion shown in FIG. 4 is enlarged.

FIG. 5 is an enlarged cross-sectional view in which the vicinity of one corner portion 14 shown in FIG. 4 is enlarged. As shown in FIGS. 4 and 5, an anchor bolt 15 is provided to protrude from the inner surface of the manhole 1. The reinforcing member 3 described later is fixed to the manhole 1 by using the anchor bolt 15. Specifically, an insertion hole 16 is formed in the reinforcing member 3, and the reinforcing member 3 is fixed to the manhole 1 by being tightened and fixed by a nut in a state in which the anchor bolt 15 is inserted into the insertion hole 16. Hereinafter, a state in which the reinforcing member 3 is fixed to the manhole 1 is described as a "fixed state". Note that the anchor bolt 15 of the present embodiment is provided to protrude from the corner inner surface 14*a* of the corner portion 14 in a direction orthogonal to the corner inner surface 14*a*. Specifically, the anchor bolt 15 of the present embodiment is provided to protrude in a direction which is inclined by about 45 degrees relative to the vertical direction and the horizontal direction.

Figure 6:
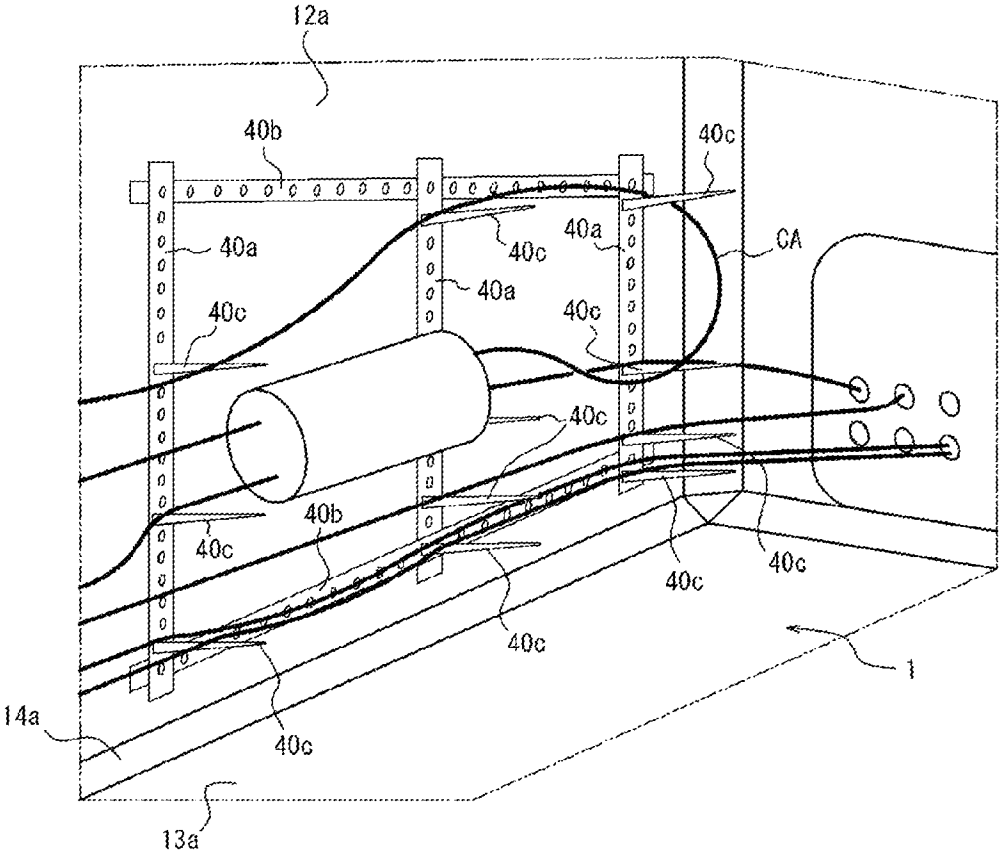
FIG. 6 is a view showing an outline of a flat steel bar member.

In addition, as shown in FIG. 5, a flat steel bar member 40 serving as installed equipment is attached onto the side wall inner surface 12*a* of the side wall 12 of the manhole 1. The flat steel bar member 40 is provided for supporting a cable or the like which extends in the manhole 1. FIG. 6 is a view showing an outline of the flat steel bar member 40. The flat steel bar member 40 includes a vertical flat steel bar 40*a* and a horizontal flat steel bar 40*b*, and is attached to the side wall inner surface 12*a*. Further, the flat steel bar member 40 shown in FIG. 6 includes a plurality of support arms 40*c* which are provided to protrude from the vertical flat steel bar 40*a*. A cable CA or the like housed in the manhole 1 is supported by, e.g., the support arms 40*c*. The reinforcing member 3 is fixed to the manhole 1 so as not to interfere with the flat steel bar member 40. The detail thereof will be described later (see FIG. 8). Note that the depiction of the flat steel bar member 40 is omitted in each of FIGS. 1 to 4.

As shown in FIGS. 1 to 5, the reinforcement structure 100 includes a strip-shaped reinforcing material 2 and the reinforcing member 3. The strip-shaped reinforcing material 2 and the reinforcing member 3 are provided in the manhole 1 and, for the convenience of description, part of the strip-shaped reinforcing material 2 and the reinforcing member 3 is shown in a solid line in FIG. 1.

The strip-shaped reinforcing material 2 is a strip-shaped (sheet-shaped) member made of reinforced fiber. The strip-shaped reinforcing material 2 is provided by being bonded to the lower floor inner surface 13*a* of the manhole 1 with an adhesive resin. As shown in FIGS. 1 and 2, the strip-shaped reinforcing material 2 is provided only on the lower floor slab 13, and is not provided on the upper floor slab 11 or the side wall 12. As the strip-shaped reinforcing material 2, it is possible to use various members such as, e.g., a member made of fiber reinforced plastic and a member made of carbon fiber.

Figure 7:
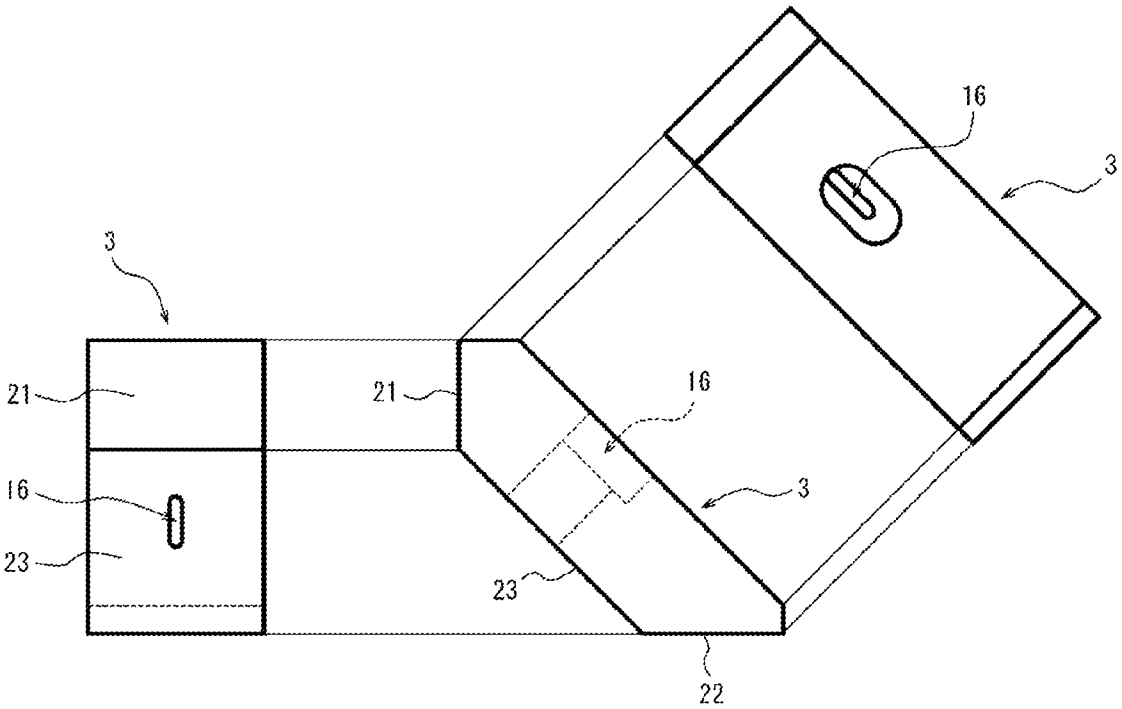
FIG. 7 is a view showing a single reinforcing member shown in FIG. 2.

FIG. 7 is a view showing a single reinforcing member 3 of the present embodiment. Specifically, FIG. 7 shows views when the reinforcing member 3 is viewed from three directions. Hereinafter, the detail of the reinforcing member 3 will be described with reference to FIGS. 1 to 5 and FIG. 7.

The reinforcing member 3 reinforces the manhole 1 by being fixed to the manhole 1 in a state in which at least part of the reinforcing member 3 is in contact with the side wall inner surface 12*a* of the inner surface of the manhole 1.

Specifically, the reinforcing member 3 of the present embodiment is disposed in a central portion in the longitudinal direction A of each of longitudinal side wall portions 17*a* and 17*b* of the side wall 12 which extend along the longitudinal direction A of the manhole 1. A plurality of the reinforcing members 3 of the present embodiment are disposed, and a plurality of the reinforcing members 3 are constituted by first reinforcing members 3*a* which fix a lower portion of the side wall 12 to the lower floor slab 13, and second reinforcing members 3*b* which fix an upper portion of the side wall 12 to the upper floor slab 11. Hereinafter, for the convenience of description, the first reinforcing member 3*a* and the second reinforcing member 3*b* are simply described as the "reinforcing members 3" in the case where the first and second reinforcing members 3*a* and 3*b* are described without being distinguished from each other.

As shown in FIGS. 4 and 5, the first reinforcing member 3*a* is provided so as to be in contact with a portion extending from the lower portion of the side wall 12 to the lower floor slab 13 via the corner portion 14 at which the side wall 12 and the lower floor slab 13 intersect each other. In addition, as shown in FIG. 4, the second reinforcing member 3*b* is provided so as to be in contact with a portion extending from the upper portion of the side wall 12 to the upper floor slab 11 via the corner portion 14 at which the side wall 12 and the upper floor slab 11 intersect each other.

Consequently, the first reinforcing member 3*a* is fixed to the manhole 1 in a state in which the first reinforcing member 3*a* is in contact with the side wall inner surface 12*a*, the corner inner surface 14*a*, and the lower floor inner surface 13*a*. In addition, the second reinforcing member 3*b* is fixed to the manhole 1 in a state in which the second reinforcing member 3*b* is in contact with the side wall inner surface 12*a*, the corner inner surface 14*a*, and the upper floor inner surface 11*a*.

As described above, in the reinforcing member 3, the insertion hole 16 into which the anchor bolt 15 provided to protrude from the inner surface of the manhole 1 can be inserted is formed. The reinforcing member 3 is tightened and fixed by the nut in the state in which the anchor bolt 15 is inserted into the insertion hole 16, and the reinforcing member 3 is thereby brought into the fixed state shown in each of FIGS. 4 and 5.

Herein, as shown in FIG. 5, the insertion hole 16 of the reinforcing member 3 is an elongated hole which allows the reinforcing member 3 to move relative to the anchor bolt 15 in an inserted state in which the anchor bolt 15 is inserted into the insertion hole 16 (hereinafter simply described as an "inserted state"), and an unfixed state in which the reinforcing member 3 is not fixed to the manhole 1 (hereinafter simply described as an "unfixed state").

By constituting the insertion hole 16 with the elongated hole in this manner, in the inserted state and the unfixed state, it becomes easy to adjust the position of the reinforcing member 3 in the fixed state. Accordingly, even in the case where the installed equipment such as the flat steel bar member 40 is attached to the side wall inner surface 12*a*, it is possible to bring the reinforcing member 3 into contact with a predetermined position of the side wall inner surface 12*a* while avoiding the installed equipment. With this, it is possible to prevent a side wall contact height from being reduced by interference with the installed equipment such as the flat steel bar member 40. The detail thereof will be described later (see FIG. 8).

In addition, as shown in FIG. 5, the first reinforcing member 3*a* includes a flat side wall contact portion 21 which is in contact with the side wall inner surface 12*a* of the manhole 1 in the fixed state, a flat lower floor contact portion 22 which is in contact with the lower floor inner surface 13*a* of the manhole 1 in the fixed state, and a flat corner contact portion 23 which is in contact with the corner inner surface 14*a* of the manhole 1 in the fixed state.

In the inserted state and the unfixed state, the side wall contact portion 21 of the present embodiment can move in a direction orthogonal to the longitudinal direction A of the manhole 1 relative to the anchor bolt 15. More specifically, in the inserted state and the unfixed state, the first reinforcing member 3*a* of the present embodiment is positioned relative to the manhole 1 (see FIG. 5 and the like) such that the insertion hole 16 becomes the elongated hole which is orthogonal to the longitudinal direction A of the manhole 1 and extends in a direction along the corner inner surface 14*a* (see an arrow "B" in FIG. 5). Consequently, even in the case where the installed equipment such as the flat steel bar member 40 is provided on the side wall 12, it is possible to move the side wall contact portion 21 in an in-plane direction of a plane orthogonal to the longitudinal direction A of the manhole 1 so as to avoid the position of the installed equipment, and bring the side wall contact portion 21 of the first reinforcing member 3*a* into contact with the predetermined position of the side wall inner surface 12*a*. With this, it is possible to prevent the side wall contact height which is a vertical height (length) of the side wall contact portion 21 in contact with the side wall inner surface 12*a* from being reduced by the interference with the installed equipment such as the flat steel bar member 40. In other words, it becomes easy to maximally utilize the side wall inner surface 12*a* positioned below the flat steel bar member 40 in the vertical direction as an area with which the side wall contact portion 21 comes into contact. The detail thereof will be described later (see FIG. 8).

Further, in the inserted state and the unfixed state, it is possible to bring the lower floor contact portion 22 of the present embodiment into contact with the lower floor inner surface 13*a* of the manhole 1. The lower floor contact portion 22 of the present embodiment determines the position in the vertical direction of the side wall contact portion 21 in the fixed state by coming into contact with the lower floor inner surface 13*a* in the inserted state and the unfixed state. In other words, the lower floor contact portion 22 of the present embodiment constitutes a vertical position determination portion which determines the position in the vertical direction of the side wall contact portion 21 in the fixed state. The detail thereof will be described later (see FIG. 8).

Furthermore, in the first reinforcing member 3*a* of the present embodiment, in the inserted state and the unfixed state, the side wall contact portion 21 is in contact with the side wall inner surface 12*a*, the lower floor contact portion 22 is in contact with the lower floor inner surface 13*a*, and the corner contact portion 23 is in contact with the corner inner surface 14*a*. In the present embodiment, by bringing the first reinforcing member 3*a* into this state, the position in the fixed state is determined. That is, by screwing the nut onto the anchor bolt 15 (see FIG. 5) in this state, the first reinforcing member 3*a* is fixed to the manhole 1, and the fixed state is implemented.

Note that the configurations of the first reinforcing member 3*a* and the second reinforcing member 3*b* of the present embodiment are identical to each other. That is, in the present embodiment, the first reinforcing member 3*a* and the second reinforcing member 3*b* are configured by causing mounting positions of the reinforcing members 3 having the same shape to the manhole 1 to differ from each other. Consequently, in the case where the first reinforcing member 3*a* shown in FIG. 5 is used as the second reinforcing member 3*b*, one of the side wall contact portion 21 and the lower floor contact portion 22 of the first reinforcing member 3*a* constitutes the side wall contact portion of the second reinforcing member 3*b*, and the other one thereof constitutes the upper floor contact portion of the second reinforcing member 3*b* which comes into contact with the upper floor inner surface 11*a*.

In the present embodiment, the insertion holes 16 of both of the first reinforcing member 3*a* and the second reinforcing member 3*b* are constituted by the elongated holes, but only one of the insertion holes 16 may be constituted by the elongated hole. In the case where the installed equipment is the flat steel bar member 40, at least the insertion hole 16 of the first reinforcing member 3*a* is preferably constituted by the elongated hole. This is because, in the case of the flat steel bar member 40, the reinforcing member tends to interfere with the flat steel bar member 40 at a position below the flat steel bar member 40 in the vertical direction. Note that, as in the present embodiment, it is especially preferable that the insertion holes 16 of both of the first reinforcing member 3*a* and the second reinforcing member 3*b* be constituted by the elongated holes. With this arrangement, it is possible to unify the design of the first reinforcing member 3*a* and the design of the second reinforcing member 3*b*. In addition, it becomes easy to cope with installed equipment even in the case where the installed equipment other than the flat steel bar member 40 is present.

Figure 8:
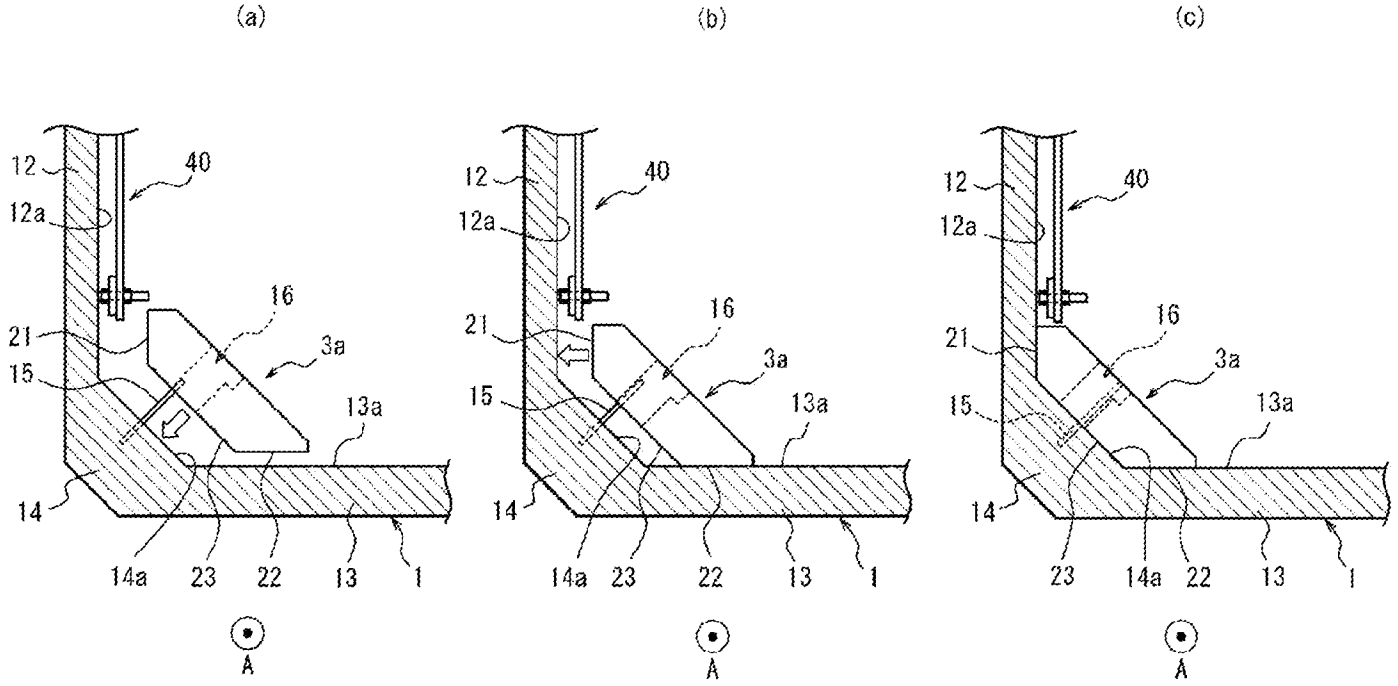
FIGS. 8(*a*), 8(*b*), and 8(*c*) are views showing an outline of a construction method as an embodiment of the present invention for fixing a first reinforcing member shown in FIG. 2 to the manhole.

Next, a description will be given of a construction method for fixing the reinforcing member 3 to the manhole 1. FIG. 8 is a view showing an outline of the construction method for fixing the first reinforcing member 3*a* to the manhole 1. Note that, for the convenience of description, a description will be given of the construction method of the first reinforcing member 3*a*, but the construction method of the second reinforcing member 3*b* (see FIG. 4 and the like) is the same as that of the first reinforcing member 3*a*.

First, as shown in FIG. 8(*a*), the anchor bolt 15 provided to protrude from the inner surface of the manhole 1 is inserted into the elongated hole serving as the insertion hole 16 formed in the first reinforcing member 3*a* (see an open arrow in FIG. 8(*a*)).

Next, as shown in FIGS. 8(*b*) and 8(*c*), in the inserted state and the unfixed state, by moving the first reinforcing member 3*a* relative to the anchor bolt 15, the position of the first reinforcing member 3*a* in the fixed state is adjusted. By using the elongated hole as the insertion hole 16, it is possible to move the first reinforcing member 3*a* relative to the anchor bolt 15 in a state in which the anchor bolt 15 is inserted into the insertion hole 16. With this, it is possible to adjust the position of the first reinforcing member 3*a* in the fixed state in the state in which the anchor bolt 15 is inserted into the insertion hole 16. Accordingly, it is possible to adjust the fixed position of the first reinforcing member 3*a* by using the elongated hole while determining the rough position of the first reinforcing member 3*a* by using the anchor bolt 15 as a guide. As a result, even in the case where the installed equipment such as the flat steel bar member 40 is provided on the side wall 12, it is possible to adjust the position of the first reinforcing member 3*a* so as to avoid the installed equipment by using the elongated hole. With this, it is not necessary to set the side wall contact height of the first reinforcing member 3*a* to a low height in consideration of the interference between the first reinforcing member 3*a* and the installed equipment when the first reinforcing member 3*a* is fixed to the manhole 1. In other words, by providing the elongated hole as the insertion hole 16, the first reinforcing member 3*a* can be configured to be capable of easily securing the side wall contact height.

Figure 9:
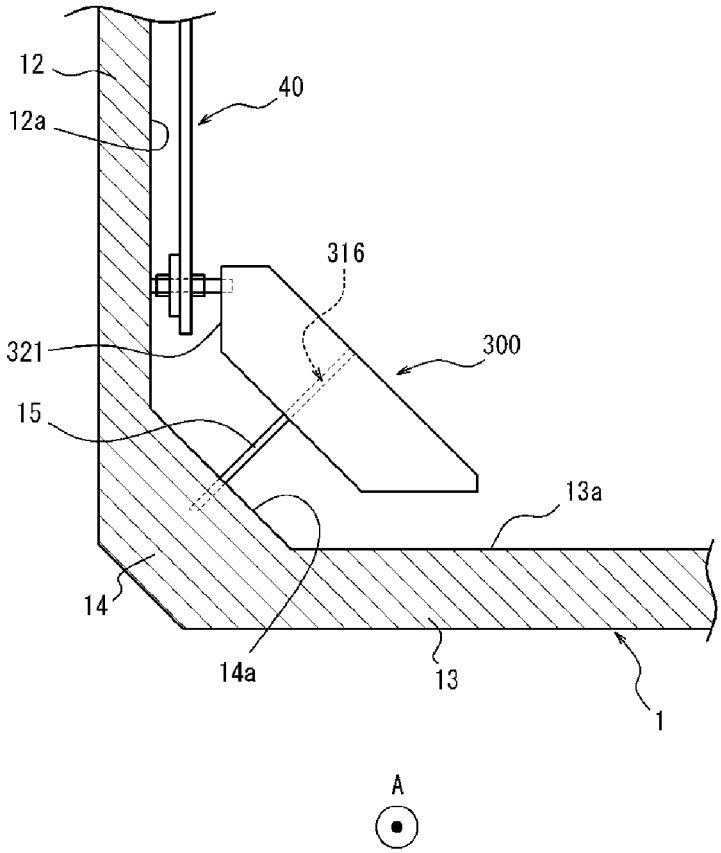
FIG. 9 is a view showing an outline of a construction method as a comparative example for fixing a reinforcing member as a comparative example to the manhole.

More specifically, in the present embodiment, as shown in FIGS. 8(*a*) to 8(*c*), in the inserted state and the unfixed state, the first reinforcing member 3*a* is moved in the direction orthogonal to the longitudinal direction A of the manhole 1 relative to the anchor bolt 15. With this, in the inserted state and the unfixed state, it is possible to adjust the position of the side wall contact portion 21 in the fixed state. FIG. 9 is a view showing an outline of a construction method for fixing a reinforcing member 300 as a comparative example to the manhole 1. The reinforcing member 300 shown in FIG. 9 is different from the reinforcing member 3 of the present embodiment in that an insertion hole 316 is not an elongated hole but a circular hole which is slightly larger than the anchor bolt 15, and the other configurations of the reinforcing member 300 are the same as those of the reinforcing member 3. As shown in FIG. 9, in the inserted state and the unfixed state, the reinforcing member 300 can move only along a direction of extension of the anchor bolt 15. Accordingly, as shown in FIG. 9, in the case where the reinforcing member 300 interferes with the flat steel bar member 40, it is not possible to move a side wall contact portion 321 to a position where the side wall contact portion 321 is in contact with the side wall inner surface 12*a*. As a result, the side wall contact height of the side wall contact portion 321 has to be reduced.

In contrast to this, in the first reinforcing member 3*a* of the present embodiment shown in FIG. 8, the insertion hole 16 is constituted by the elongated hole. Accordingly, in the inserted state and the unfixed state, it is possible to move the first reinforcing member 3*a* in the direction orthogonal to the longitudinal direction A of the manhole 1 relative to the anchor bolt 15. As a result, it is possible to move the side wall contact portion 21 to the predetermined position where the side wall contact portion 21 is in contact with the side wall inner surface 12*a* while avoiding the flat steel bar member 40 and while maintaining the side wall contact height of the side wall contact portion 21.

Further, as shown in FIGS. 8(*b*) and 8(*c*), in the first reinforcing member 3*a* of the present embodiment, by bringing the lower floor contact portion 22 into contact with the lower floor inner surface 13*a* in the inserted state and the unfixed state, it is possible to determine the position in the vertical direction of the side wall contact portion 21 in the fixed state. That is, by moving the first reinforcing member 3*a* down to the position where the first reinforcing member 3*a* is in contact with the lower floor inner surface 13*a* in the inserted state, it is possible to determine the position in the vertical direction of the side wall contact portion 21 in the fixed state.

In addition, in the present embodiment, in the state in which the lower floor contact portion 22 of the first reinforcing member 3*a* is in contact with the lower floor inner surface 13*a*, the lower floor contact portion 22 is caused to slide relative to the lower floor inner surface 13*a*, and the side wall contact portion 21 is brought into contact with the side wall inner surface 12*a*. That is, in the state in which the lower floor contact portion 22 of the first reinforcing member 3*a* is in contact with the lower floor inner surface 13*a*, the lower floor contact portion 22 is caused to slide toward the side wall inner surface 12*a* so as to be pushed in in the horizontal direction (see an open arrow in FIG. 8(*b*)), and the side wall contact portion 21 is brought into contact with the side wall inner surface 12*a*. With this, it is possible to bring the side wall contact portion 21 into contact with the side wall inner surface 12*a*, bring the lower floor contact portion 22 into contact with the lower floor inner surface 13*a*, and bring the corner contact portion 23 into contact with the corner inner surface 14*a*, and determine the position of the first reinforcing member 3*a* in the fixed state.

Thus, according to the first reinforcing member 3*a* of the present embodiment, it is possible to maximally utilize the area of the side wall inner surface 12*a* below the installed equipment such as the flat steel bar member 40 in the vertical direction, and maintain the side wall contact height of the first reinforcing member 3*a*. As a result, it is possible to obtain a high effect of reinforcing the manhole 1. As a result, it is possible to use facilities safely for a long period of time.

Figure 10:
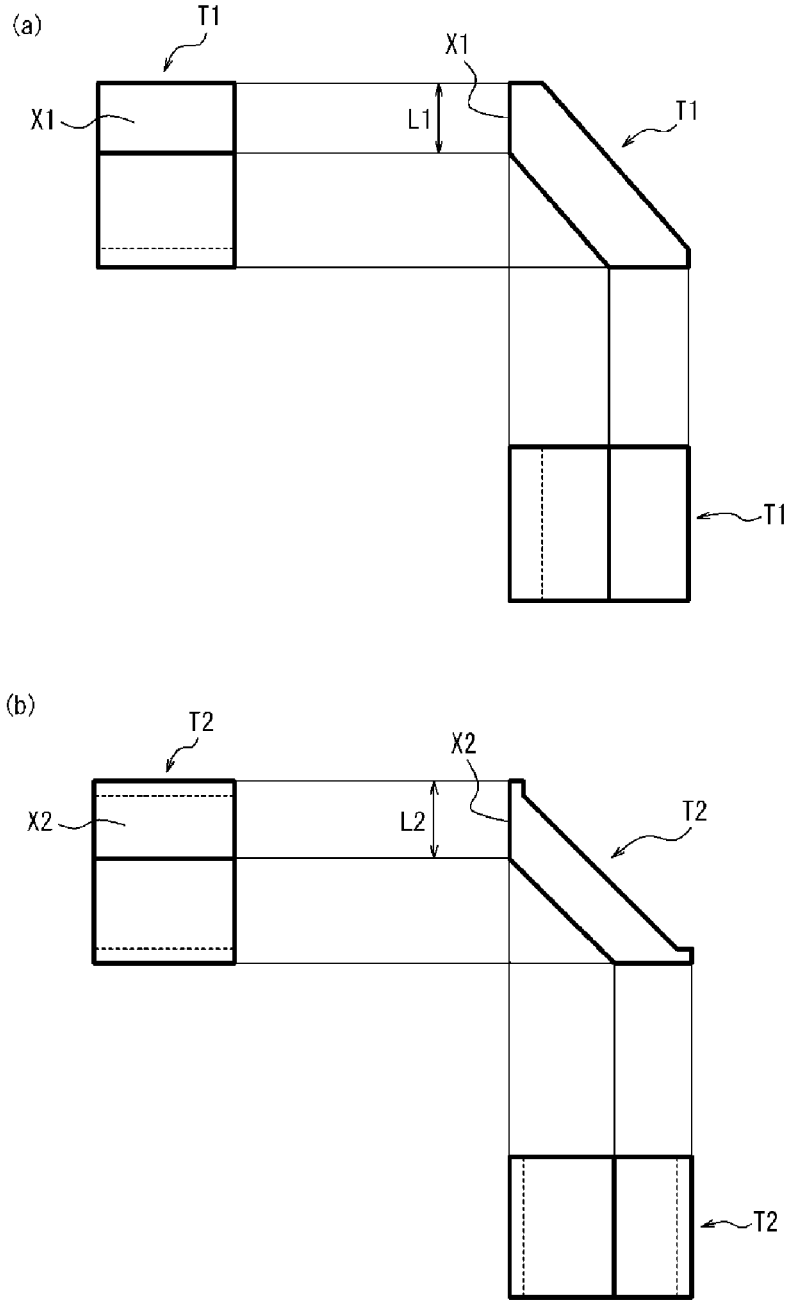
FIGS. 10(*a*) and 10(*b*) are views showing two test specimens of the reinforcing member.

Lastly, a description will be given of a result of FEM (Finite Element Method) analysis in which an influence of the side wall contact height on the reinforcement effect was determined. FIG. 10 is a view showing two test specimens of the reinforcing member. While a length L1 of a side wall contact portion X1 of one test specimen T1 is 90 mm, a length L2 of a side wall contact portion X2 of the other test specimen T2 is 110 mm. The reinforcement effect in the case where each of the two test specimens T1 and T2 was used as the first reinforcing member 3*a* was studied by the FEM analysis. Note that the FEM analysis is performed under the same conditions such as conditions of the configuration of the manhole, the position of the strip-shaped reinforcing material 2 installed only on the lower floor inner surface, and an external force to be applied except differences between the test specimens T1 and T2. In addition, the side wall contact height of the test specimen T1 is 90 mm, which is equal to the length L1 of the side wall contact portion X1. The side wall contact height of the test specimen T2 is 110 mm, which is equal to the length L2 of the side wall contact portion X2.

Figure 11:
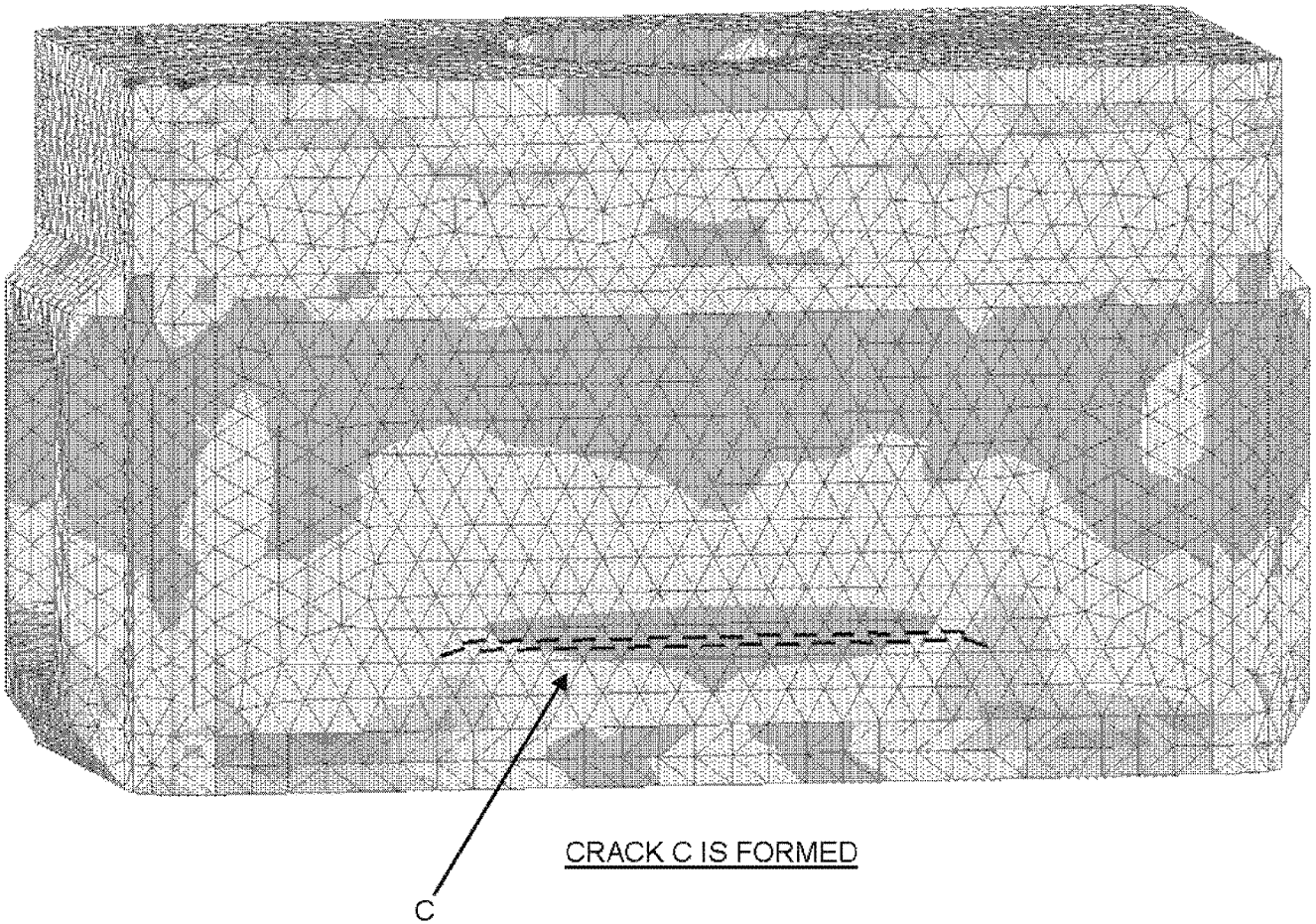
FIG. 11 is a view showing an analysis result of one test specimen having a lower side wall contact height.
Figure 12:
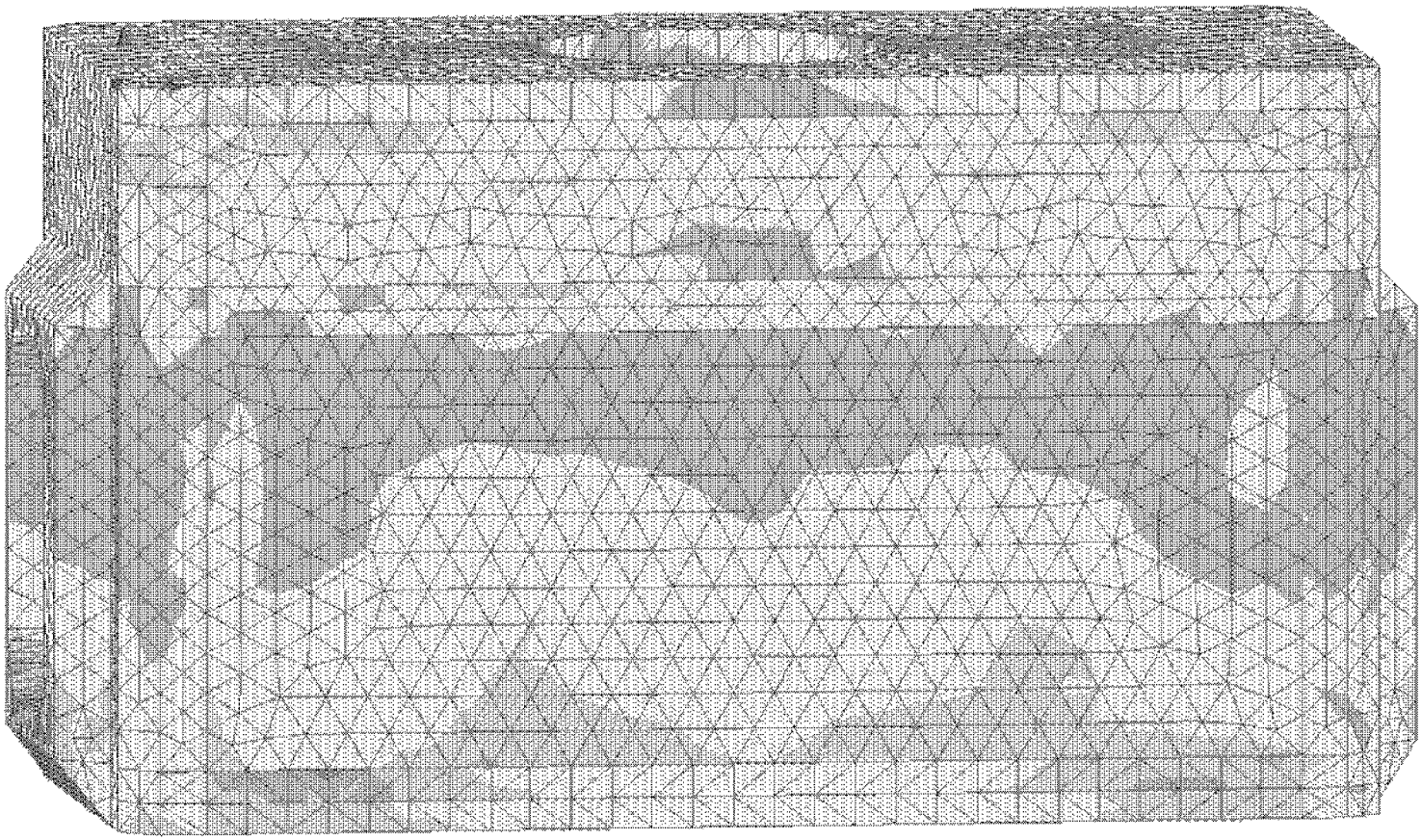
FIG. 12 is a view showing an analysis result of the other test specimen having a higher side wall contact height.

FIG. 11 is a view showing the result of the FEM analysis of the test specimen T1. FIG. 12 is a view showing the result of the FEM analysis of the test specimen T2. As shown in FIG. 11, it can be seen that, in the test specimen T1 having the low side wall contact height, a crack C is formed. In contrast to this, it can be seen that, in the test specimen T2 having the high side wall contact height, the crack is not formed, and the high reinforcement effect is obtained. From this, it is possible to determine that the reinforcement effect is enhanced by increasing the side wall contact height as high as possible.

The reinforcing member and the construction method according to the present invention are not limited to specific configurations and steps shown in the above embodiments, and various modifications and changes can be made without departing from the scope of claims.

INDUSTRIAL APPLICABILITY

The present invention relates to a reinforcing member and a construction method which reinforce a manhole.

REFERENCE SIGNS LIST

1 Manhole
2 Strip-shaped reinforcing material
3 Reinforcing member
3*a* First reinforcing member
3*b* Second reinforcing member
11 Upper floor slab
11*a* Upper floor inner surface
12 Side wall
12*a* Side wall inner surface
13 Lower floor slab
13*a* Lower floor inner surface
14 Corner portion
14*a* Corner inner surface
15 Anchor bolt
16 Insertion hole
17*a*, 17*b* Longitudinal side wall portion
21 Side wall contact portion
22 Lower floor contact portion
23 Corner contact portion
40 Flat steel bar member (installed equipment)
40*a* Vertical flat steel bar
40*b* Lateral flat steel bar
40*c* Support arm
50*a* Opening portion
50*b* Pit portion
100 Reinforcement structure

300 Reinforcing member as comparative example
316 Insertion hole of reinforcing member as comparative example
321 Side wall contact portion of reinforcing member as comparative example
A Longitudinal direction of manhole
C Crack
CA Cable
T1, T2 Test specimen
L1, L2 Length of side wall contact portion of test specimen
X1, X2 Side wall contact portion of test specimen

The invention claimed is:

1. A reinforcement member of a structure buried underground for reinforcing the structure, wherein the reinforcement member is in contact with a side wall inner surface of an inner surface of the structure, the reinforcement member comprising:

an insertion hole, wherein the insertion hole receives an anchor bolt provided to protrude from the inner surface of the structure, wherein the insertion hole is an elongated hole allowing the reinforcement member to move relative to the anchor bolt when the reinforcement member is in a combination of states including:

an inserted state in which the anchor bolt is inserted into the insertion hole, and an unfixed state in which the reinforcement member is not fixed to the structure, and wherein the reinforcement member in contact with the side wall inner surface of the inner surface of the structure has a vertical length of a least a predetermined length relative to a vertical position of an installed equipment attached to the side wall inner surface of the inner surface of the structure from a lower floor inner surface of the structure.

2. The reinforcement member of claim 1, the reinforcement member further comprising:

a side wall contact portion, wherein the side wall contact portion is in contact with the side wall inner surface of the structure when the reinforcement member is in a fixed state, wherein the fixed state represents a state of the structure indicating the reinforcement member is fixed to the structure, and wherein the side wall contact portion is moveable in a direction orthogonal to a longitudinal direction of the structure when the reinforcement member is in the combination of states including the inserted state and the unfixed state.

3. The reinforcement member of claim 2, the reinforcement member further comprising:

a lower floor contact portion, wherein the lower floor contact portion is in contact with the lower floor inner surface of the structure when the reinforcement member is in the combination of states including the inserted state and the unfixed state, wherein the lower floor contact portion further comprises:

a vertical position determination portion, wherein, when the reinforcement member is in the combination of states including the inserted state and the unfixed state, the vertical position determination portion comes into contact with the lower floor inner surface of the structure thereby determining a position in a vertical direction of the side wall contact portion when the reinforcement member is in the fixed state.

4. The reinforcement member of claim 3, the reinforcement member further comprising:

a corner contact portion, wherein the corner contact portion is positioned between the side wall inner surface and the lower floor inner surface of the structure and comes into contact with a corner inner surface inclined relative to the side wall inner surface of the structure and the lower floor inner surface of the structure, and wherein, when the reinforcement member is in the fixed state, the lower floor contact portion is in contact with the lower floor inner surface and the corner contact portion is in contact with the corner inner surface of the structure.

5. The reinforcement member of claim 2, wherein the structure relates to a manhole.

6. The reinforcement member of claim 2, further comprising a movable side wall contact portion, wherein the movable side wall contact portion is positioned on a side wall of the structure to prevent the reinforcement member from interfering with a flat bar-shaped member affixed to the lower floor inner surface of the structure.

7. The reinforcement member of claim 6, wherein the flat bar-shaped member includes a plurality of support arms holding cables.

8. A method for reinforcing a structure buried underground, the method comprising:

inserting an anchor bolt provided to protrude from an inner surface of the structure into an elongated hole formed in a reinforcement member, wherein the reinforcement member is in contact with a side wall inner surface of the inner surface of the structure;

when the reinforcement member is in a combination of states including an inserted state and in an unfixed state, moving the reinforcement member relative to the anchor bolt, wherein the inserted state represents the anchor bolt being inserted into the elongated hole of the reinforcement member, and wherein the unfixed state represents the reinforcement member is not fixed to the structure; and when the reinforcement member is in a fixed state, determining a position of the reinforcement member, wherein the fixed state represents the reinforcement member being fixed to the structure, and wherein the reinforcement member in contact with the side wall inner surface of the inner surface of the structure has a vertical length of a least a predetermined length relative to a vertical position of an installed equipment attached to the side wall inner surface of the inner surface of the structure from a lower floor inner surface of the structure.

9. The method of claim 8, wherein the reinforcement member includes a side wall contact portion, wherein the reinforcement member is in the fixed state, the side wall contact portion is in contact with the side wall inner surface of the inner surface of the structure, and wherein, when the reinforcement member is in the combination of states including the inserted state and the unfixed state, the side wall contact portion is moveable in a direction orthogonal to a longitudinal direction of the structure.

10. The method of claim 9, wherein the reinforcement member includes a lower floor contact portion, wherein the lower floor contact portion is in contact with the lower floor inner surface of the structure when the reinforcement member is in the combination of states including the inserted state and the unfixed state, wherein the lower floor contact portion further comprises:

a vertical position determination portion, wherein, when the reinforcement member is in the combination of states including the inserted state and the unfixed state, the vertical position determination portion comes into contact with the lower floor inner surface thereby determining a position in a vertical direction of the side wall contact portion when the reinforcement member is in the fixed state.

11. The method of claim 10, wherein the reinforcement member includes a corner contact portion, wherein the corner contact portion is positioned between the side wall inner surface and the lower floor inner surface of the structure and comes into contact with a corner inner surface inclined relative to the side wall inner surface and the lower floor inner surface, and wherein, when the reinforcement member is in the fixed state, the lower floor contact portion is in contact with the lower floor inner surface and the corner contact portion is in contact with the corner inner surface of the structure.

12. The method of claim 9, wherein the structure relates to a manhole.

13. The method of claim 9, wherein the reinforcement member further includes a movable side wall contact portion, wherein the movable side wall contact portion is positioned on a side wall of the structure to prevent the reinforcement member from interfering with a flat bar-shaped member affixed to the lower floor inner surface of the structure.

14. The method of claim 13, wherein the flat bar-shaped member includes a plurality of support arms holding cables.

15. A system of a structure buried underground, the system comprising:

the structure including:

a side wall, an upper floor slab, a lower floor slab, and a corner portion; and a reinforcement member, wherein the reinforcement member is in contact with a side wall inner surface representing an inner surface of the side wall of the structure, wherein the reinforcement member has a vertical length of a least a predetermined length relative to a vertical position of an installed equipment attached to the side wall inner surface of the inner surface of the structure from a lower floor inner surface of the structure, the reinforcement member comprising:

an insertion hole, wherein the insertion hole receives an anchor bolt provided to protrude from the inner surface of the structure, wherein the insertion hole is an elongated hole allowing the reinforcement member to move relative to the anchor bolt when the reinforcement member is in a combination of states including:

an inserted state in which the anchor bolt is inserted into the insertion hole, and an unfixed state in which the reinforcement member is not fixed to the structure.

16. The system of claim 15, the reinforcement member further comprising:

a side wall contact portion, wherein the side wall contact portion is in contact with the side wall inner surface of the structure when the reinforcement member is in a fixed state, wherein the fixed state represents a state of the structure indicating the reinforcement member is fixed to the structure, and wherein the side wall contact portion is moveable in a direction orthogonal to a longitudinal direction of the structure when the reinforcement member is in the combination of states including the inserted state and the unfixed state.

17. The system of claim 16, the reinforcement member further comprising:

a lower floor contact portion, wherein the lower floor contact portion is in contact with the lower floor inner surface of the structure representing an inner surface of the lower floor slab of the structure when the reinforcement member is in the combination of states including the inserted state and the unfixed state, and the lower floor contact portion further comprises:

a vertical position determination portion, wherein, when the reinforcement member is in the combination of states including the inserted state and the unfixed state, the vertical position determination portion comes into contact with the lower floor inner surface thereby determining a position in a vertical direction of the side wall contact portion when the reinforcement member is in the fixed state.

18. The system of claim 17, the reinforcement member further comprising:

a corner contact portion, wherein the corner contact portion is positioned between the side wall inner surface and the lower floor inner surface of the structure and comes into contact with a corner inner surface of the corner portion of the structure inclined relative to the side wall inner surface and the lower floor inner surface, and wherein, when the reinforcement member is in the fixed state, the lower floor contact portion is in contact with the lower floor inner surface and the corner contact portion is in contact with the corner inner surface of the structure.

19. The system of claim 16, the reinforcement member further comprising:

a movable side wall contact portion, wherein the movable side wall contact portion is positioned on the side wall to prevent the reinforcement member from interfering with a flat bar-shaped member affixed to the lower floor inner surface of the structure.

20. The system of claim 19, wherein the flat bar-shaped member includes a plurality of support arms holding cables.

* * * * *